US011110576B2

(12) United States Patent
Namouz

(10) Patent No.: US 11,110,576 B2
(45) **Date of Patent: *Sep. 7, 2021**

(54) GAS SPRING FASTENER DRIVER

(71) Applicant: TECHTRONIC CORDLESS GP, Anderson, SC (US)

(72) Inventor: Essam Namouz, Greenville, SC (US)

(73) Assignee: TECHTRONIC CORDLESS GP, Anderson, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/773,086

(22) Filed: Jan. 27, 2020

(65) Prior Publication Data

US 2020/0156227 A1 May 21, 2020

Related U.S. Application Data

(63) Continuation of application No. 15/619,887, filed on Jun. 12, 2017, now Pat. No. 10,569,403.

(60) Provisional application No. 62/352,627, filed on Jun. 21, 2016.

(51) Int. Cl.
*B25C 1/04* (2006.01)
*B25C 1/06* (2006.01)

(52) U.S. Cl.
CPC ..... *B25C 1/046* (2013.01); *B25C 1/045* (2013.01); *B25C 1/047* (2013.01); *B25C 1/06* (2013.01); *B25C 1/04* (2013.01)

(58) Field of Classification Search
USPC ..... 227/130, 90; 173/90, 130
See application file for complete search history.

(56) References Cited

U.S. PATENT DOCUMENTS

| | | | |
|---|---|---|---|
| 3,278,103 | A | 10/1966 | Juilfs et al. |
| 3,809,307 | A | 5/1974 | Wandel et al. |
| 3,871,566 | A | 3/1975 | Elliesen et al. |
| 3,940,044 | A | 2/1976 | LaPointe |
| 3,948,426 | A | 4/1976 | LaPointe |
| 4,122,904 | A | 10/1978 | Haytayan |
| 4,215,808 | A | 8/1980 | Sollberger et al. |
| 4,227,637 | A | 10/1980 | Haytayan |
| 4,260,092 | A | 4/1981 | Austin |
| 4,339,065 | A | 7/1982 | Haytayan |
| 4,346,831 | A | 8/1982 | Haytayan |

(Continued)

FOREIGN PATENT DOCUMENTS

| | | | |
|---|---|---|---|
| CN | 202129781 | U | 2/2012 |
| CN | 103216561 | A | 7/2013 |
| WO | 2005095063 | A1 | 10/2005 |

*Primary Examiner* — Chelsea E Stinson
*Assistant Examiner* — Jacob A Smith
(74) *Attorney, Agent, or Firm* — Michael Best & Friedrich LLP

(57) ABSTRACT

A fastener driver includes a drive blade movable from a retracted position to a driven position for driving a fastener into a work piece. The fastener driver further includes a gas spring mechanism for driving the drive blade from the retracted position to the driven position. The gas spring mechanism is moveable between a retracted state and a driven state. The fastener driver further includes a first return mechanism for moving the drive blade from the driven position toward the retracted position, and a second return mechanism for returning the gas spring mechanism toward the retracted state separately from movement of the drive blade.

20 Claims, 6 Drawing Sheets

(56) References Cited

U.S. PATENT DOCUMENTS 4,384,668 A 5/1983 Tutomu et al.
4,452,387 A 6/1984 Haytayan
RE32,452 E 7/1987 Nikolich
4,821,938 A 4/1989 Haytayan
4,909,419 A 3/1990 Yamada et al.
5,020,712 A 6/1991 Monacelli
5,511,715 A 4/1996 Crutcher et al.
5,645,208 A 7/1997 Haytayan
5,683,024 A 11/1997 Eminger et al.
5,720,423 A * 2/1998 Kondo ..... B25C 1/04 227/130
5,921,156 A 7/1999 Takezaki et al.
5,941,441 A * 8/1999 Ilagan ..... B25C 1/06 227/131
6,145,724 A 11/2000 Shkolnikov et al.
6,318,615 B1 11/2001 Walter
6,564,788 B1 * 5/2003 Hu ..... F41B 7/003 124/66
RE38,834 E 10/2005 Perra
7,073,468 B2 7/2006 Akiba et al.
7,137,540 B2 11/2006 Terrell et al.
7,290,691 B1 11/2007 Wen
7,490,747 B2 2/2009 Kitagawa
7,686,197 B2 3/2010 Kosuge et al.
7,730,881 B1 * 6/2010 Pedicini ..... F04B 35/04 124/65
8,011,441 B2 9/2011 Leimbach et al.
8,011,547 B2 9/2011 Leimbach et al.
8,230,941 B2 7/2012 Leimbach et al.
8,267,297 B2 9/2012 Leimbach et al.
8,286,722 B2 10/2012 Leimbach et al.
8,387,718 B2 3/2013 Leimbach et al.
8,602,282 B2 12/2013 Leimbach et al.
8,763,874 B2 7/2014 McCardle et al.
8,875,969 B2 11/2014 Pedicini et al.
9,267,296 B2 2/2016 Maurer et al.
9,539,714 B1 * 1/2017 Pedicini ..... B25C 1/04
2002/0108993 A1 * 8/2002 Harper ..... B25C 1/06 227/51
2005/0156008 A1 7/2005 Komazaki et al.
2005/0218176 A1 10/2005 Schell et al.
2006/0261127 A1 11/2006 Wolf et al.
2007/0114260 A1 * 5/2007 Petrocelli ..... B25C 1/047 227/130
2009/0090759 A1 * 4/2009 Leimbach ..... B25C 1/047 227/10
2009/0250500 A1 * 10/2009 Brendel ..... B25C 1/06 227/132
2011/0198381 A1 * 8/2011 McCardle ..... B25C 1/06 227/8
2012/0286014 A1 * 11/2012 Pedicini ..... B25C 1/04 227/4
2013/0037593 A1 * 2/2013 Porth ..... B25C 5/1627 227/10
2014/0069671 A1 3/2014 Leimbach et al.
2015/0352702 A1 * 12/2015 Chien ..... B25C 1/047 227/130
2016/0096259 A1 * 4/2016 Pedicini ..... B25C 1/047 227/146
2016/0229043 A1 * 8/2016 Wyler ..... B25C 1/06
2016/0288305 A1 * 10/2016 McCardle ..... B25C 1/047
2017/0100829 A1 * 4/2017 Pedicini ..... B25C 1/047
2017/0274513 A1 * 9/2017 Pedicini ..... B25C 1/06
2017/0355069 A1 * 12/2017 Scott ..... B25C 1/047
2018/0193993 A1 * 7/2018 Pedicini ..... B25D 17/06

* cited by examiner

GAS SPRING FASTENER DRIVER

CROSS-REFERENCE TO RELATED APPLICATIONS

This application is a continuation of U.S. patent application Ser. No. 15/619,887 filed on Jun. 12, 2017, which claims priority to U.S. Provisional Patent Application No. 62/352,627 filed on Jun. 21, 2016, the entire contents of both of which are incorporated herein by reference.

FIELD OF THE INVENTION

The present invention relates to power tools, and more particularly to gas spring fastener drivers.

BACKGROUND OF THE INVENTION

There are various fastener drivers used to drive fasteners (e.g., nails, tacks, staples, etc.) into a workpiece known in the art. These fastener drivers operate utilizing various means (e.g., compressed air generated by an air compressor, electrical energy, flywheel mechanisms) known in the art, but often these designs are met with power, size, and cost constraints.

SUMMARY OF THE INVENTION

The present invention provides, in one aspect, a fastener driver including a drive blade movable from a retracted position to a driven position for driving a fastener into a work piece. The fastener driver also includes a gas spring mechanism for driving the drive blade from the retracted position to the driven position. The gas spring mechanism is moveable between a retracted state and a driven state. The fastener driver further includes a first return mechanism for moving the drive blade from the driven position toward the retracted position, and a second return mechanism for returning the gas spring mechanism toward the retracted state separately from movement of the drive blade.

The present invention provides, in another aspect, a method of operating a fastener driver. The method includes initiating a drive cycle, and releasing a gas spring mechanism from a retracted state thereby driving a drive blade from a retracted position to a driven position. The method also includes moving the drive blade from the driven position toward the retracted position with a first return mechanism, and moving the gas spring mechanism from a driven state toward the retracted state with a second return mechanism. The second return mechanism is configured to return the gas spring mechanism toward the retracted state separately from the drive blade.

Other features and aspects of the invention will become apparent by consideration of the following detailed description and accompanying drawings.

Figure 1:
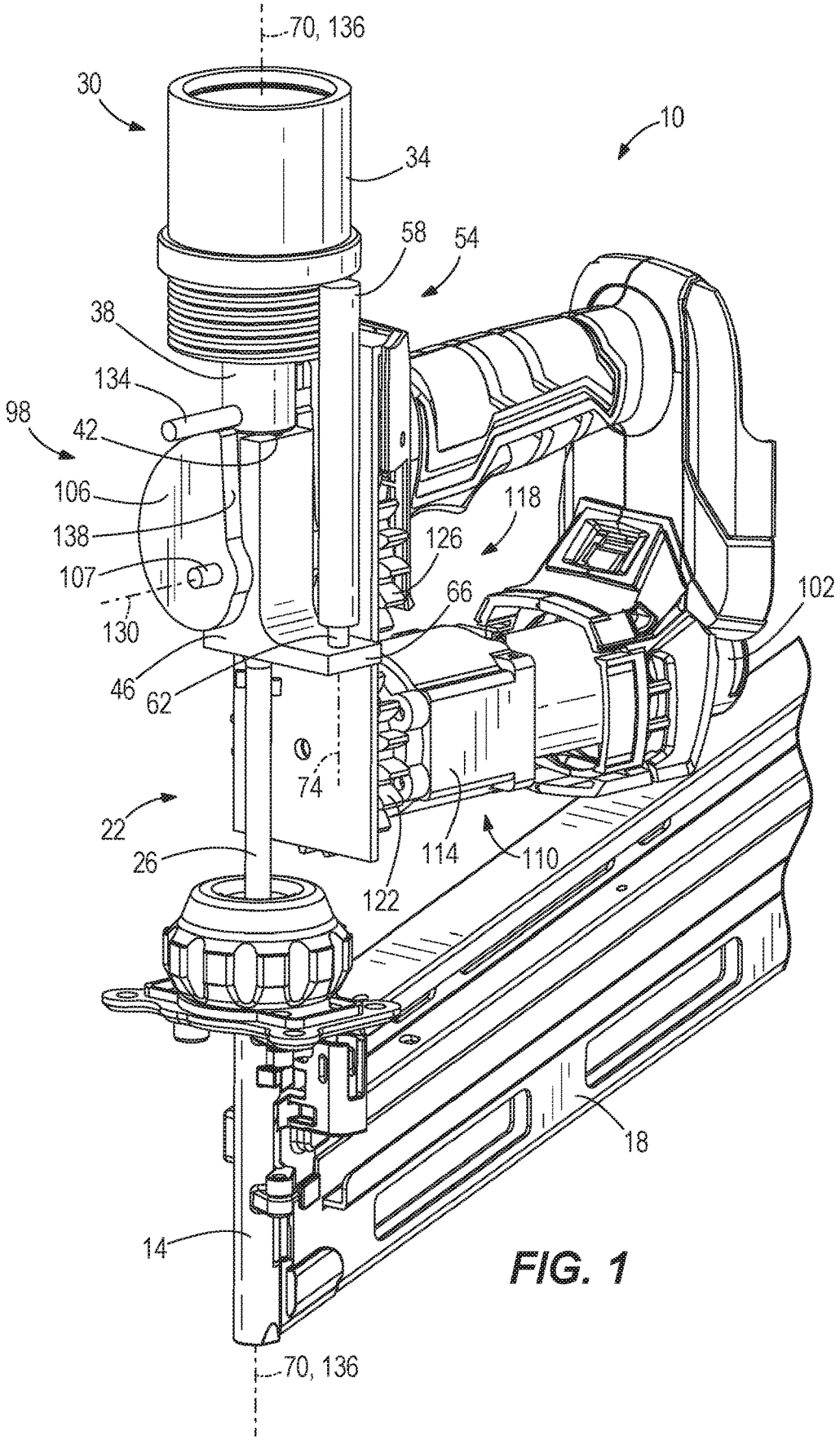
FIG. 1 is a front perspective view of a gas spring fastener driver in accordance with an embodiment of the invention, illustrating a drive blade in a retracted position and a piston in a retracted position, just prior to initiating a fastener firing operation.
Figure 2:
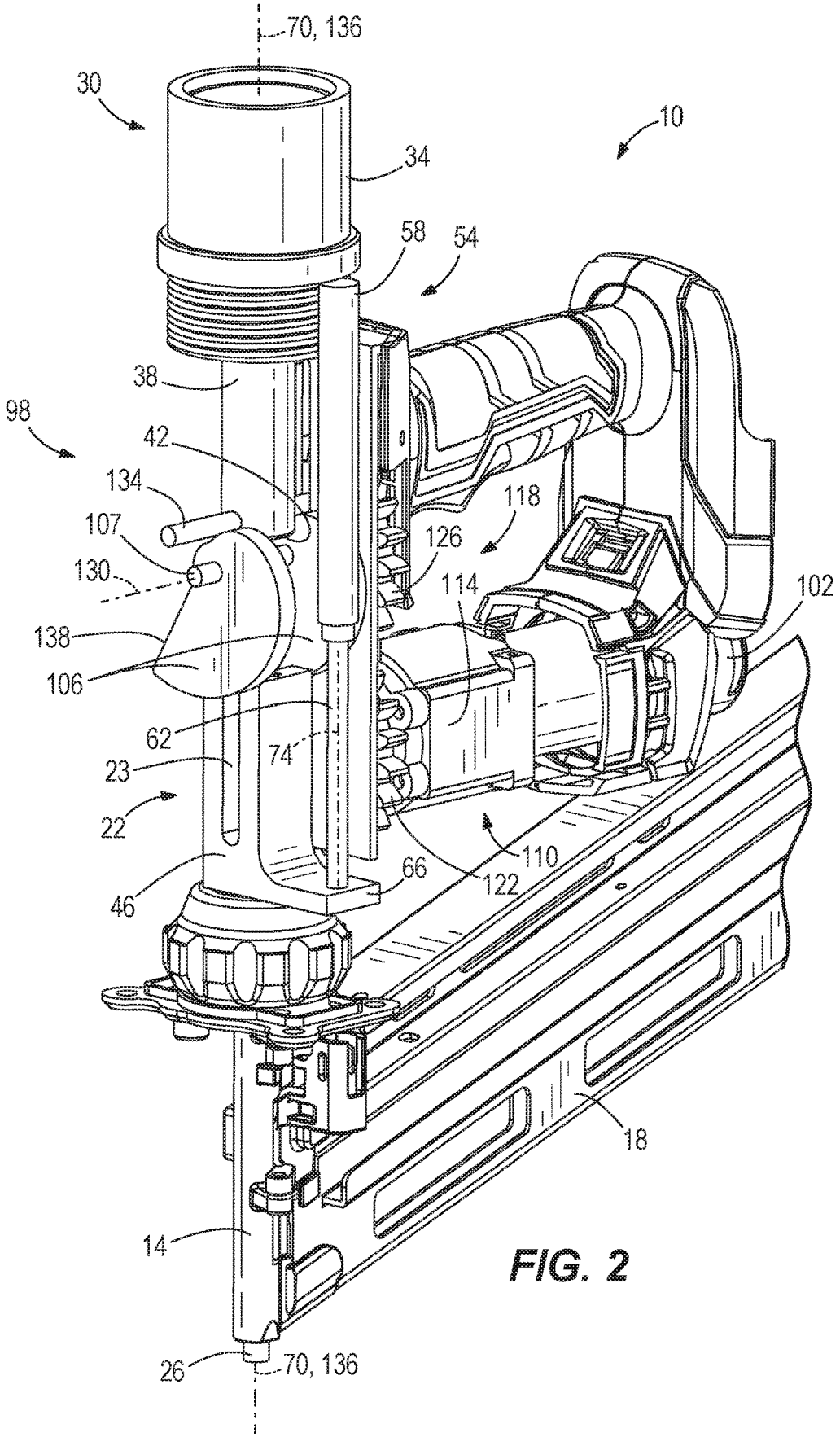
FIG. 2 is a front perspective view of the gas spring fastener driver of FIG. 1, illustrating the drive blade in a driven position and the piston in the driven position, after a fastener firing operation and just prior to the drive blade and piston being simultaneously raised to their retracted positions.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

With reference to FIGS. 1-5, a gas spring fastener driver 10 for driving fasteners (e.g., nails, tacks, staples, etc.) into a workpiece is shown. The fastener driver 10 includes a main housing (not shown), a nosepiece 14 extending from the main housing, and a magazine 18 for sequentially feeding collated fasteners into the nosepiece 14 prior to each fastener-driving operation. The fastener driver 10 also includes a drive blade 22, a tip 26 of which is received within the nosepiece 14, and an onboard gas spring mechanism 30 for driving the drive blade 22 from a retracted position (shown in FIG. 1) toward a driven position (shown in FIG. 2) coinciding with ejection of a fastener from the nosepiece 14. Accordingly, the fastener driver 10 does not require an external source of air pressure or other external power source for driving the drive blade 22.

With reference to FIG. 1, the gas spring mechanism 30 includes a cylinder housing 34 (shown as transparent in FIGS. 1-4) in which a pressurized gas (e.g., air) is stored and a piston 38 protruding from the cylinder housing 34. The pressurized gas biases the piston 38 toward a driven position (shown in FIGS. 2 and 4) in which it is fully extended from the cylinder housing 34. The piston 38 includes a distal end 42 against which a head 46 of the drive blade 22 is abuttable when the drive blade 22 is in the retracted position (shown in FIG. 1). Movement of the drive blade 22 is limited to axial reciprocation, between the retracted position and the driven position. For example, movement of the drive blade 22 may be limited in this manner by one or more guide rails along which the head 46 of the drive blade 22 is slidable.

With reference to FIGS. 1-4, the fastener driver 10 also includes a first return mechanism for raising the drive blade 22 from the driven position toward the retracted position. In the illustrated embodiment of the fastener driver 10, the first return mechanism is an extensible cylinder 54 including a cylinder housing 58 affixed to the main housing such that the cylinder housing 58 is stationary relative to the main housing and the cylinder housing 34 of the gas spring mechanism 30. The cylinder housing 58 of the extensible cylinder 54 may be affixed directly to the main housing. Alternatively, the cylinder housing 58 of the extensible cylinder 54 may be affixed to an intermediate component of the fastener driver 10 which, either directly or indirectly, is affixed to the main housing.

The extensible cylinder 54 also includes a rod 62 coupled to the head 46 of the drive blade 22 for movement with the drive blade 22. In the illustrated embodiment of the fastener driver 10, the rod 62 is abutted against a flange 66 (FIG. 1) extending in a lateral direction from a longitudinal axis 70 of the drive blade 22, and secured to the flange 66 using a fastener (e.g., a screw). Alternatively, the rod 62 may be affixed to the head 46 of the drive blade 22 using a welding process, adhesives, an interference fit, or by integrally forming, for example. Accordingly, the rod 62 is axially movable between a retracted position coinciding with the retracted positions of the piston 38 and the drive blade 22 (shown in FIG. 1), and an extended position coinciding with the driven position of the drive blade 22 (shown in FIG. 2). A longitudinal axis 74 of the extensible cylinder 54, therefore, is oriented parallel with the longitudinal axis 70 of the drive blade 22. Alternatively, the rod 62 may be coupled directly or indirectly to the main housing, and the cylinder housing 58 of the extensible cylinder 54 may be affixed to the drive blade 22.

Figure 6:
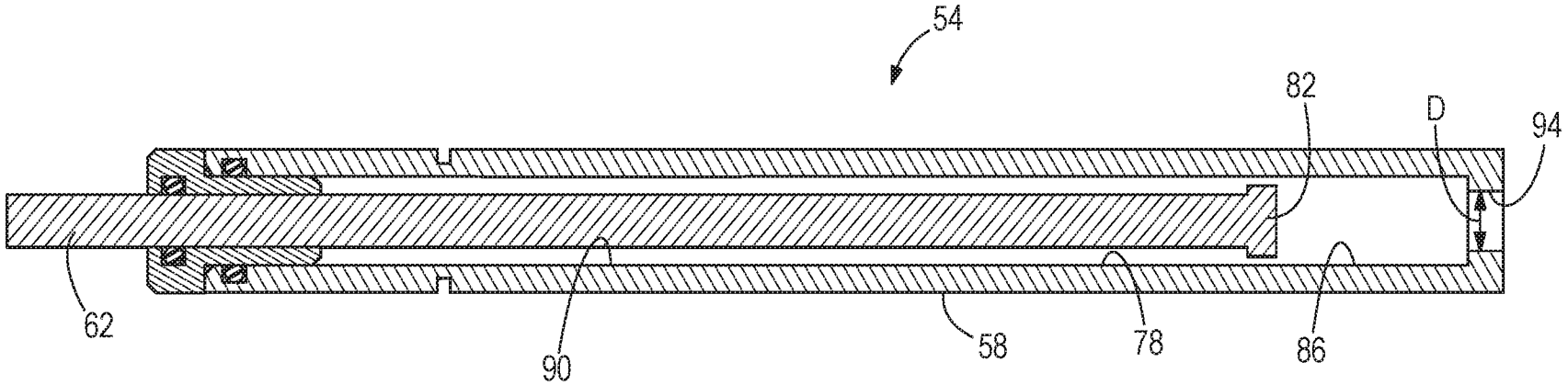
FIG. 6 is a cross-sectional view of an extensible cylinder of the gas spring fastener drive of FIG. 1, illustrating a rod of the extensible cylinder in a retracted position.

With reference to FIG. 6, the cylinder housing 58 of the extensible cylinder 54 includes an interior chamber 78 in which the rod 62 is slidable. The rod 62 includes a piston 82 that divides the interior chamber 78 into a first variable volume region 86 and a second variable volume region 90, the length of each of which is variable and dependent upon the axial position of the rod within the cylinder housing 58. The cylinder housing 58 includes an aperture 94 at one end thereof to fluidly communicate the first variable volume region 86 with an interior of the main housing, which is exposed to atmospheric pressure. In the illustrated embodiment of the fastener driver 10, the aperture 94 is coaxial with the rod 62. Alternatively, the aperture 94 may be radially oriented relative to the longitudinal axis 74 of the extensible cylinder 54. The rod 62 extends through the opposite end of the cylinder housing 58, with the second variable volume chamber 90 being exposed to the atmospheric pressure in the interior of the main housing.

With continued reference to FIG. 6, the aperture 94 includes a diameter D. During a firing stroke of the drive blade 22 (to which the rod 62 is affixed), the rod 62 is accelerated quickly from its retracted position (FIG. 1) toward the extended position (FIG. 2), thereby expanding the volume of the first variable volume region 86 in a relatively short time period. The diameter D of the aperture 94 is sized to restrict, but not prohibit, the flow of replacement air into the first variable volume region 86 during this period of expansion. Accordingly, a vacuum (i.e., an absolute pressure less than atmospheric pressure) is created in the first variable volume region as the rod 62 is extended. Because the second variable volume region 90 is exposed to atmospheric pressure, no back-pressure is exerted on the rod 62 during extension. In other words, a vacuum is created in the cylinder housing 58 for biasing the rod 62 toward a retracted position. Alternatively, the cylinder housing 58 may include a pressurized gas biasing the rod 62 toward the retracted position.

In another embodiment of the fastener driver 10, a one-way valve (not shown) may be substituted for the aperture 94 to prevent the flow of replacement air into the first variable volume region 86 during extension of the rod 62 relative to the cylinder housing 58, thereby creating a vacuum in the first variable volume region 86. When the rod 62 is retracted into the cylinder housing 58 to the position shown in FIG. 1, any pressurized air within the first variable volume region 86 (i.e., air pressurized above atmospheric pressure) is discharged through the aperture 94 and the one-way valve into the interior of the main housing. Such a one-way valve may be, for example, a ball check valve.

As is described in further detail below, between two consecutive firing operations of the fastener driver 10, the extensible cylinder 54 returns or raises the drive blade 22 from the driven position (shown in FIG. 2, coinciding with ejection of a fastener from the nosepiece 14) to a retracted position (shown in FIG. 1). The fastener driver 10 further includes a second return mechanism (i.e., a lifter mechanism 98) that raises the piston 38 from the driven position (FIG. 2) toward the retracted position (FIG. 1). In the illustrated embodiment, the gas spring mechanism 30, the extensible cylinder 54, and the lifter mechanism 98 are at least partly enclosed by the main housing. The extensible cylinder 54 and the lifter mechanism 98 operate simultaneously, or in parallel with each other, to return the drive blade 22 and the piston 38, respectively, to their retracted positions. As explained in greater detail below, simultaneously returning both the driver blade 22 and the piston 38 to their retracted positions reduces the cycle time of each fastener-firing operation, thereby increasing the speed at which fasteners may be driven into a workpiece.

Figure 5:
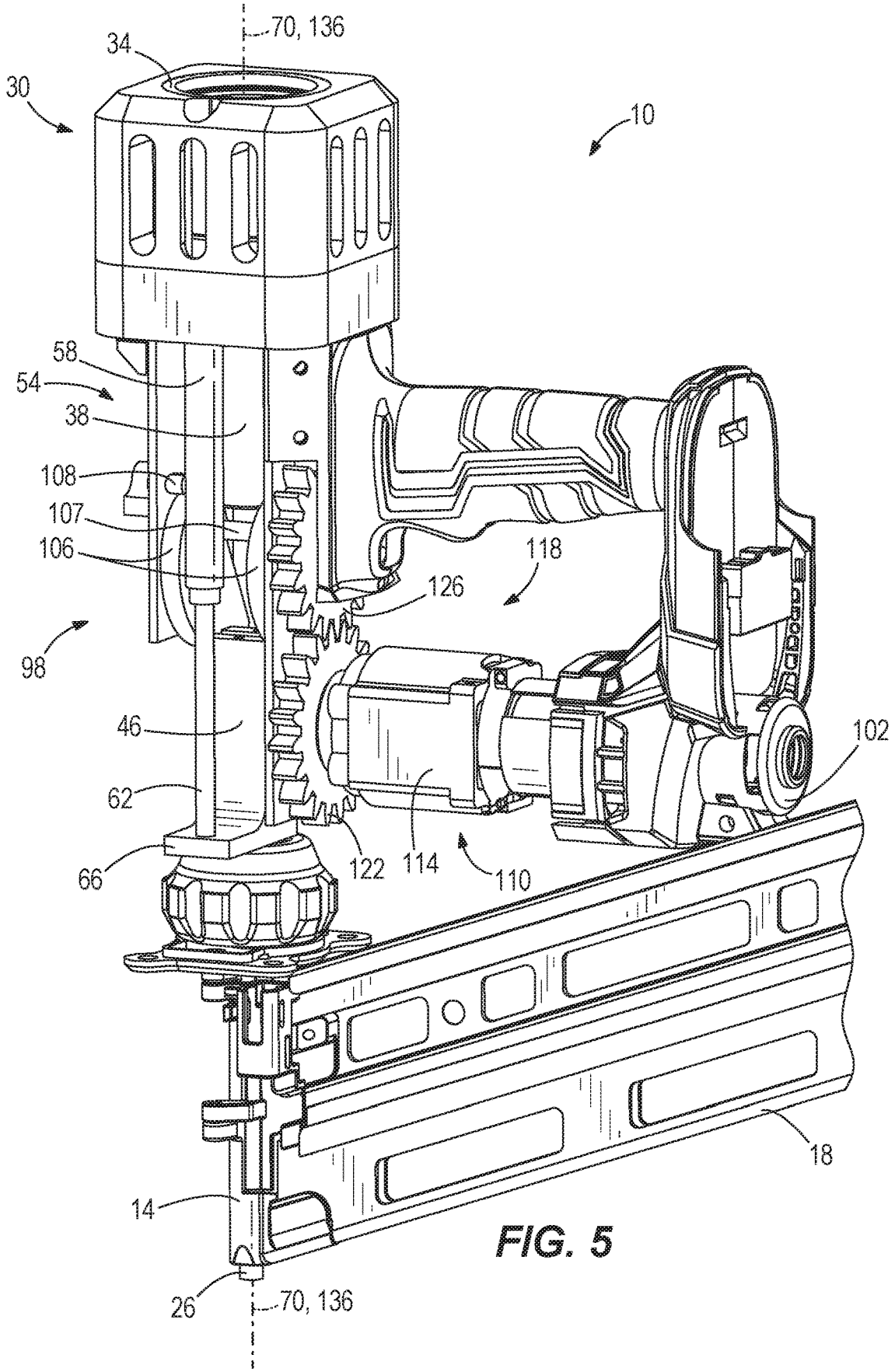
FIG. 5 is a rear perspective view of the gas spring fastener driver of FIG. 2.

In the illustrated embodiment of the fastener driver 10 as shown in FIG. 1, the lifter mechanism 98 includes an electric motor 102 powered by an on-board power source (e.g., a battery), two rotatable cam lobes 106 mounted on a cam shaft 107, and a transmission 110 interconnecting the motor 102 and the cam lobes 106. With reference to FIG. 5, the transmission 110 includes a planetary gear train 114 connected to an output shaft of the motor 102 and an offset gear train 118 connected to the output of the planetary gear train 114. Specifically, the offset gear train 118 includes a first gear 122 connected with the output of the planetary gear train 114, a second gear 126 enmeshed with the first gear 122 and connected with the cam shaft 107 and cam lobes 106. Accordingly, torque from the motor 102 is transferred through the planetary gear train 114 and the offset gear train 118, causing the cam lobes 106 to rotate about a rotational axis 130 of the second gear 126 (FIG. 1), which is coaxial with the cam shaft 107.

With reference to FIGS. 1-4, the piston 38 includes a follower 134 engaged with the cam lobes 106 while the piston 38 is raised from the driven position to the retracted position. In the illustrated embodiment of the fastener driver 10, the follower 134 is configured as a cylindrical pin that is slidable along the outer periphery of the cam lobes 106 in response to rotation of the cam lobes 106. In other words, the follower 134 is positioned between the cam lobes 106 and the piston 38. The follower 134 is coupled for movement with the piston 38 between the driven and retracted positions of the piston 38. Furthermore, the follower 134 protrudes from the piston 38 in a lateral (i.e., transverse) direction relative to the longitudinal axis 136 of the piston 38 (which in the illustrated embodiment is coaxial with the longitudinal axis 70 of the driver blade 22), and the cam lobes 106 are positioned on opposite sides of the drive blade 22 and the piston 38.

In operation of the fastener driver 10, a first firing operation is commenced by the user depressing a trigger (not shown) of the fastener driver 10. Before the trigger is pulled and while the fastener driver 10 is at rest or idle, the drive blade 22 is held in the retracted position by the extensible cylinder 54 and the piston 38 is held in the retracted position by the cam lobes 106 (FIG. 1). A spring-biased pin 108 (FIG. 5) prevents the cam lobes 106 from being back-driven by the piston 38 while the piston 38 is held in the retracted position. Specifically, the spring-biased pin 108 allows the cam lobes 106 to rotate freely in the counterclockwise direction as viewed from the frame of reference of FIG. 1, but prevents the cam lobes 106 from rotating in the opposite, clockwise direction. For example, the spring-biased pin 108 may include a ramped surface (not shown) to allow the cam lobes 106 to pass over the pin 108 in one direction by deflecting the pin 108 against the spring bias. While at rest, the head 46 of the drive blade 22 is abutted against the distal end 42 of the piston 38.

Shortly after the trigger being depressed, the motor 102 is activated to rotate the cam lobes 106 in a counter-clockwise direction about the rotational axis 130 from the frame of reference of FIG. 1. Upon the follower 134 sliding off the tip of the cam lobes 106, the pressurized gas within the cylinder housing 34 expands, pushing the piston 38 outward from the cylinder housing 34 and accelerating the drive blade 22 toward its driven position. The cam lobes 106 are accelerated to a sufficient rotational speed to prohibit subsequent contact with the follower 134 as the piston 38 is being driven from its retracted position to the driven position. In addition, the timing of the piston 38 reaching an intermediate position coincides with the follower 134 passing alongside a flat segment 138 of the cam lobes 106 (shown most clearly in FIG. 1), thereby creating an unobstructed path for the follower 134 as the piston 38 is displaced from its retracted position toward its driven position.

After the piston 38 reaches its driven position (shown in FIG. 2), the head 46 of the drive blade 22 separates from the distal end 42 of the piston 38, ceasing further acceleration of the drive blade 22. Thereafter, the drive blade 22 continues moving toward its driven position at a relatively constant velocity. Upon impact with a fastener in the nosepiece 14, the drive blade 22 begins to decelerate, ultimately being stopped after the fastener is driven into a workpiece.

During the period of movement of the drive blade 22 from its retracted position (FIG. 1) to its driven position (FIG. 2), because the rod 62 of the extensible cylinder 54 is affixed to the head 46 of the drive blade 22 for movement therewith, the rod 62 is also pulled from the cylinder housing 58. As the rod 62 is pulled from the cylinder housing 58, a vacuum is created within the cylinder housing 58. After movement of the drive blade 22 is stopped following the conclusion of the first firing operation, a pressure imbalance applies a force on the rod 62, causing it to retract into the cylinder housing 58. Because the rod 62 is affixed to the head 46 of the drive blade 22, the drive blade 22 is raised from its driven position toward the retracted position. As stated earlier, a pressurized gas within the extensible cylinder 54 may alternatively be utilized to raise the drive blade 22 from its driven position toward the retracted position.

Figure 3:
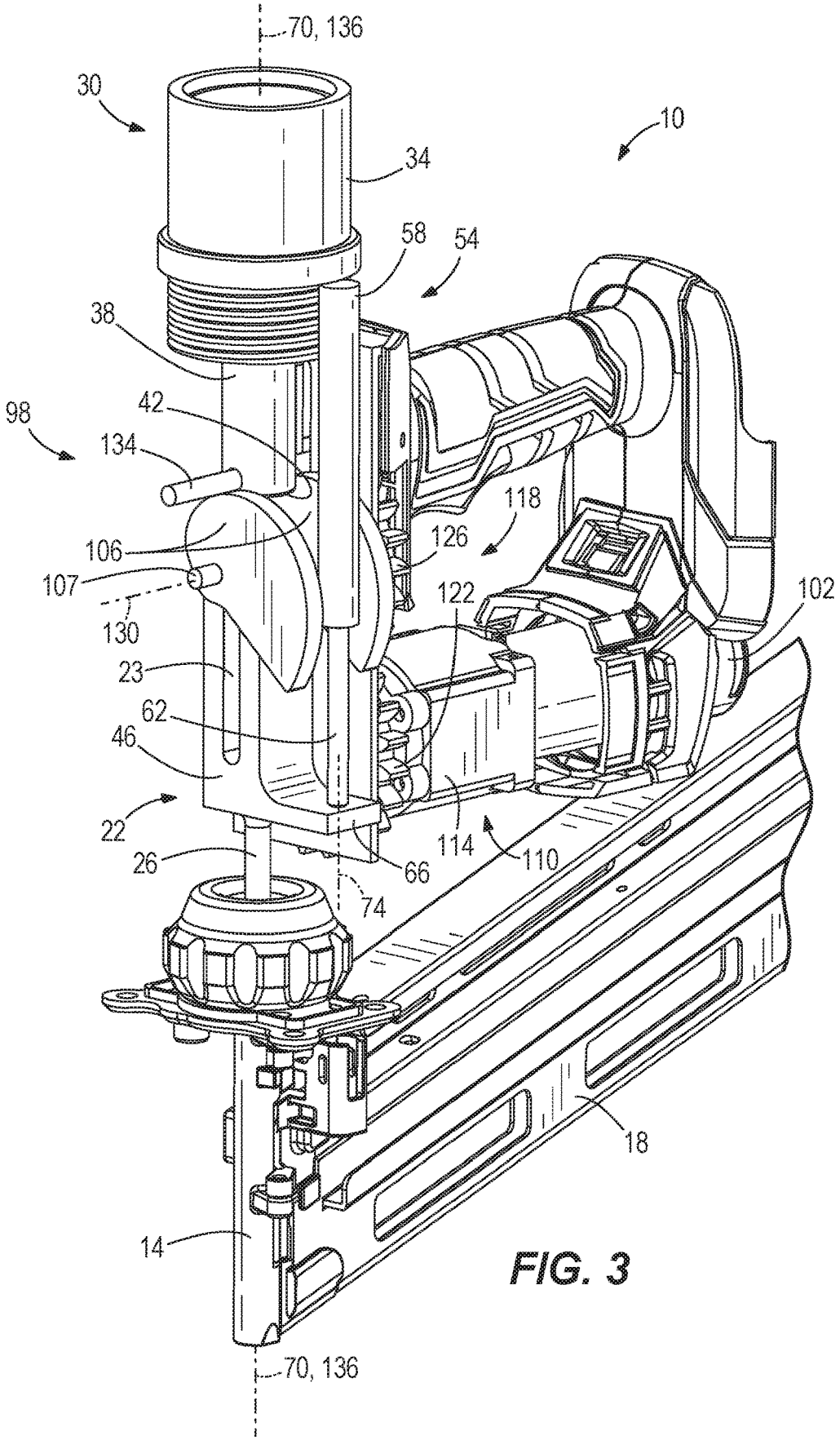
FIG. 3 is a front perspective view of the gas spring fastener driver of FIG. 1, illustrating the drive blade in an intermediate position and the piston in an intermediate position, with both the drive blade and the piston being simultaneously raised to their retracted positions.

Coinciding with the drive blade 22 rising toward the retracted position, rotation of the cam lobes 106 (in the same counter-clockwise direction) is resumed (or alternatively accelerated if previously slowed) to once again contact the follower 134 (shown in FIG. 3). As the cam lobes 106 continue their rotation, the follower 134 and the piston 38 are displaced upward from the driven position shown in FIG. 2 toward the retracted position shown in FIG. 1. The drive blade 22 rises faster than the piston 38 such that the head 46 of the drive blade 22 comes into contact with the distal end 42 of the piston 38 after an initial time period following the firing operation. Contact between the drive blade 22 and the piston 38 is maintained by the extensible cylinder 54 continuously applying a biasing force on the drive blade 22 in the direction of the piston 38. Alternatively, magnets positioned on the head 46 of the drive blade 22 and/or the distal end 42 of the piston 38 may be used to magnetically latch the drive blade 22 to the piston 38 as both are moved to their raised positions. The drive blade 22 includes a groove 23 (FIG. 2) that receives the cam shaft 107, so the drive blade 22 and the cam shaft 107 do not engage as the drive blade 22 is moved toward its raised position by the extensible cylinder 54.

The cam lobes 106 continue to raise the piston 38 and the extensible cylinder 54 continues to raise the drive blade 22, at the same time and in parallel with each other, until both reach their retracted positions shown in FIG. 1, at which time the first firing operation is completed. In other words, the piston 38 begins moving towards its retracted position via the cam lobes 106 simultaneously with the drive blade 22 moving towards its retracted position via the extensible cylinder 54. Thereafter, additional firing operations may be initiated in a like manner.

By immediately beginning to raise the piston 38 to its retracted position as soon as a firing operation is completed, the time it takes to complete a single firing cycle can be reduced, allowing for more rapid placement of fasteners into a workpiece. In addition, simultaneously raising the drive blade 22 and the piston 38 with the extensible cylinder 54 and the lifting mechanism 98 reduces the amount of current draw from the battery because the piston 38 can be compressed over a longer time period. Said another way, separating return movement of the drive blade 22 from return movement of the gas spring mechanism 30 reduces the cycle time of the fastener tool 10 to allow it to be used more rapidly, decreases the current draw by compressing the gas spring mechanism 30 over a longer period of time, and increases the available time to return the drive blade 22 without delaying the firing cycle.

By providing the extensible cylinder 54 to return the drive blade 22 to its retracted position following each fastener firing operation (i.e., as opposed to using the lifter mechanism 98 to raise the drive blade 22 from its driven position to its retracted position), the cycle time between consecutive firing operations may be reduced, allowing for more rapid placement of fasteners into a workpiece.

Figure 4:
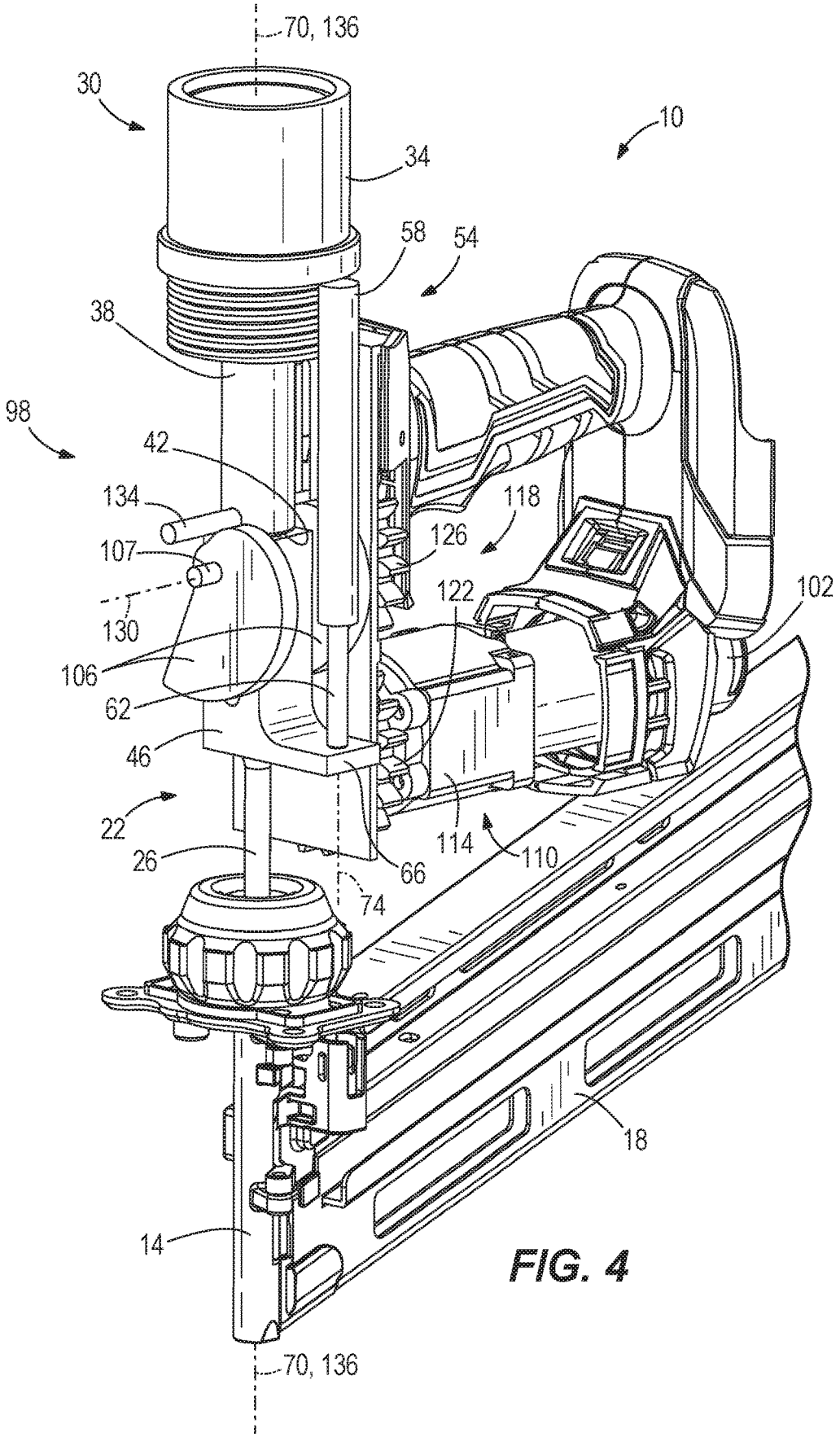
FIG. 4 is a front perspective view of the gas spring fastener driver of FIG. 1, illustrating the drive blade in an alternative rest position and a piston of a gas spring mechanism in a driven position, just prior to initiating a fastener firing operation.

With reference to FIG. 4, in an alternative firing cycle, the lifter mechanism 98 may remain deactivated after the extensible cylinder 54 has returned the drive blade 22 to contact the piston 38. The fastener driver 10 is shown in a rest or idle state in FIG. 4 with the drive blade 22 shown in an intermediate position while the piston 38 is shown in the driven position. In other words, the piston 38 is maintained in its driven position shown in FIG. 1, until the user depresses the trigger to initiate a firing operation. This way, the gas spring mechanism 30 remains in a deactivated or de-energized state (i.e., with the piston 38 in its biased, driven position) when the fastener driver 10 is not in use. If the trigger is not pulled again or a subsequent firing cycle is otherwise not desired, the piston 38 is not raised and the fastener driver 10 remains in the idle state shown in FIG. 4. At the time of pulling the trigger from the idle state, the drive blade 22 and the piston 38 are driven to their retracted positions, respectively, by the extensible cylinder 54 and the cam lobes 106 (shown in FIG. 1). Alternatively or additionally, the fastener driver 10 includes a timer to determine if the piston 38 has been held in the retracted position for greater than a predetermined amount of time. If the piston 38 has been in the retracted position for greater than the predetermined amount of time, the fastener tool 10 de-energizes the gas spring mechanism 30 and returns to the idle state shown in FIG. 4.

Various features of the invention are set forth in the following claims.

What is claimed is:

1. A fastener driver comprising:

a drive blade movable from a retracted position to a driven position for driving a fastener into a workpiece;

a gas spring mechanism for driving the drive blade from the retracted position to the driven position, the gas spring mechanism being movable between a retracted state and a driven state;

a first return mechanism for moving the drive blade from the driven position toward the retracted position; and a second return mechanism for returning the gas spring mechanism toward the retracted state separately from movement of the drive blade.

2. The fastener driver of claim 1, wherein the second return mechanism returns the gas spring toward the retracted state as the drive blade returns toward the retracted position.

3. The fastener driver of claim 1, wherein the second return mechanism returns the gas spring toward the retracted state as the drive blade is still advancing toward the driven position.

4. The fastener driver of claim 1, wherein a firing operation of the fastener driver is complete when the drive blade reaches the driven position, and wherein the second return mechanism is configured to return the gas spring mechanism toward the retracted state immediately after a firing operation is completed.

5. The fastener driver of claim 1, wherein the gas spring mechanism includes a piston movable between a retracted position and a driven position, wherein in the driven state of the gas spring mechanism, the piston is in the driven position, and in the retracted state of the gas spring mechanism, the piston is in the retracted position.

6. The fastener driver of claim 5, wherein when the gas spring mechanism is in the retracted state and the drive blade is in the retracted position, the piston abuts the drive blade.

7. The fastener driver of claim 5, wherein when the gas spring mechanism is in the driven state and the drive blade is in the driven position, the piston is spaced from the drive blade.

8. The fastener driver of claim 1, wherein the first return mechanism is an extensible cylinder.

9. The fastener driver of claim 8, further comprising a main housing in which the gas spring mechanism, the first return mechanism, and the second return mechanism are at least partly enclosed, wherein the extensible cylinder comprises a cylinder housing coupled to one of the main housing or the drive blade, and a rod coupled to the other of the main housing or the drive blade.

10. The fastener driver of claim 1, wherein the second return mechanism comprises a cam lobe engageable with the gas spring mechanism, and wherein the gas spring mechanism is moved from the driven state to the retracted state in response to rotation of the cam lobe.

11. The fastener driver of claim 10, wherein the gas spring mechanism includes a piston movable between a driven position and a retracted position, and wherein a follower is coupled for movement with the piston.

12. The fastener driver of claim 11, wherein the follower comprises a pin engageable with the cam lobe.

13. The fastener driver of claim 1, wherein the second return mechanism includes a cam lobe rotatably supported on a cam shaft, and wherein the drive blade includes a groove that receives the cam shaft to prevent engagement between the drive blade and the cam shaft as the drive blade moves between the retracted position and the driven position.

14. A method of operating a fastener driver, the method comprising:

initiating a drive cycle;

releasing a gas spring mechanism from a retracted state thereby driving a drive blade from a retracted position to a driven position;

moving the drive blade from the driven position toward the retracted position with a first return mechanism; and moving the gas spring mechanism from a driven state toward the retracted state with a second return mechanism, the second return mechanism configured to return the gas spring mechanism toward the retracted state separately from the drive blade.

15. The method of claim 14, further comprising moving the gas spring mechanism from the driven state toward the retracted state immediately after a firing operation of the fastener driver is complete, wherein a firing operation is complete when the drive blade reaches the driven position.

16. The method of claim 14, wherein the first return mechanism is an extensible cylinder including a cylinder housing coupled to one of a main housing or the drive blade and a rod coupled to the other of the main housing or the drive blade, and wherein the method further comprises:

creating a vacuum in the cylinder housing for biasing the rod toward a retracted position.

17. The method of claim 14, wherein the second return mechanism includes a cam lobe engageable with the second return mechanism, and wherein the method further comprises:

rotating the cam lobe to move the gas spring mechanism from the driven state to the retracted state; and rotating the cam lobe to release the gas spring mechanism.

18. The method of claim 14, wherein the step of moving the gas spring mechanism from the driven state toward the retracted state with a second return mechanism is performed as the drive blade returns toward the retracted position.

19. The method of claim 14, wherein the step of moving the gas spring mechanism from the driven state toward the retracted state with a second return mechanism is performed as the drive blade is still advancing toward the driven position.

20. The method of claim 14, wherein the second return mechanism includes a cam lobe rotatably supported on a cam shaft, and wherein the drive blade includes a groove that receives the cam shaft to prevent engagement between the drive blade and the cam shaft as the drive blade moves between the retracted position and the driven position.

* * * * *